US006439665B1

(12) United States Patent
Cvek

(10) Patent No.: US 6,439,665 B1
(45) Date of Patent: Aug. 27, 2002

(54) ERGONOMIC CHAIR WITH MESH SEAT AND BACK

(75) Inventor: Sava M. Cvek, Jamaica Plain, MA (US)

(73) Assignee: Stylex, Delanco, NJ (US)

( * ) Notice: Subject to any disclaimer, the term of this patent is extended or adjusted under 35 U.S.C. 154(b) by 0 days.

(21) Appl. No.: 09/590,939

(22) Filed: Jun. 9, 2000

(51) Int. Cl.[7] ..... A47C 7/00

(52) U.S. Cl. ..... 297/440.11; 297/452.56; 297/452.63; 297/452.64; 297/452.38

(58) Field of Search ..... 297/452.56, 440.11, 297/452.63, 452.64, 452.38

(56) References Cited

U.S. PATENT DOCUMENTS

| | | | | |
|---|---|---|---|---|
| 3,061,374 A | | 10/1962 | Grosfillex | |
| 3,120,407 A | | 2/1964 | Propst | |
| 3,230,011 A | | 1/1966 | Propst | |
| 3,794,382 A | | 2/1974 | Bloomfield et al. | |
| 4,302,048 A | | 11/1981 | Yount | |
| D335,777 S | | 5/1993 | Hess | |
| D346,279 S | | 4/1994 | Stumpf et al. | |
| D375,848 S | | 11/1996 | Grosfillex | |
| 5,582,463 A | * | 12/1996 | Linder et al. | 297/452.2 |
| 5,632,526 A | | 5/1997 | McLarty, III et al. | |
| 5,671,975 A | | 9/1997 | Muller | |
| D386,023 S | | 11/1997 | Stumpf et al. | |
| D401,077 S | | 11/1998 | Lewis | |
| D405,967 S | | 2/1999 | Lewis | |
| 6,035,901 A | | 3/2000 | Stumpf et al. | |
| D425,717 S | | 5/2000 | Tseng | |
| 6,059,368 A | | 5/2000 | Stumpf et al. | |
| 6,254,190 B1 | * | 7/2001 | Gregory | 297/452.1 |
| 6,293,624 B1 | * | 9/2001 | Gaylord et al. | 297/440.11 |

* cited by examiner

*Primary Examiner*—Carl D. Friedman
*Assistant Examiner*—Dennis L. Dorsey
(74) *Attorney, Agent, or Firm*—Stuart E. Beck

(57) ABSTRACT

An ergonomic chair comprising a frame having outer and inner peripheries and an upper surface. A mesh supporting surface is supported on the outer periphery of the frame. The mesh supporting surface deflects to at least a first predetermined angle when a person is sitting on the chair. The inner periphery of the frame is located below the angle of deflection of the mesh so that the mesh does not engage the inner periphery when it supports a person sits on the chair.

36 Claims, 4 Drawing Sheets

ERGONOMIC CHAIR WITH MESH SEAT AND BACK

FIELD OF THE INVENTION

This invention relates to chairs, and more particularly, to a stackable, ergonomic chair with a mesh back and seat.

BACKGROUND OF THE INVENTION

It is generally known to make chairs with backs and seats comprising mesh supporting surfaces comprised of yieldable resilient surfaces that deflect when sat upon. It is believed that such chairs are more comfortable than chairs made with solid seats and backs since they more easily conform to the shape of the body of a seated person.

A typical chair having such characteristics is disclosed in Stumpf et al., U.S. Pat. No. 6,059,368.

However, it has not been generally recognized that a better sitting experience can be achieved by maximizing the transverse distance of the mesh supporting surface relative to the body of the seated person.

Further, it has not been generally recognized that varying the resistance to deflection of different parts of the mesh supporting surface when person sits on the chair in accordance with the weight that it will bear during seating will minimize muscle fatigue and will minimize interference with blood circulation through the lower back and legs.

Accordingly, it would be advantageous to provide an ergonomic chair having a mesh support surface where different parts of the mesh have different resistance to deflection in accordance with the load that they will have to support when a person sits on the chair.

It would be additionally beneficial if the mesh supporting surface were supported by that outer periphery of a frame having a central opening so that when the mesh supporting surface is deflected, it does not touch the other parts of the frame.

SUMMARY OF THE INVENTION

With the foregoing in mind, the invention relates to an ergonomic chair that includes a frame that has outer and inner peripheries and an upper surface. A mesh supporting surface for supporting a portion of a body of a person is provided. The mesh supporting surface is supported on the outer periphery of said frame. It is comprised of a yieldable resilient material which deflects to at least a first predetermined angle when supporting a portion of the body of a person. The inner periphery of the frame is disposed below the angle of deflection of the mesh so that the mesh does not engage the inner periphery when it supports a portion of the body of a person.

In another aspect of the invention the mesh supporting surface is comprised of transverse fibers which are normally under tension and some of said fibers are under more tension than other fibers to reduce their deflection under load.

DETAILED DESCRIPTION OF A PRESENTLY PREFERRED FORM OF THE INVENTION

Figure 1:
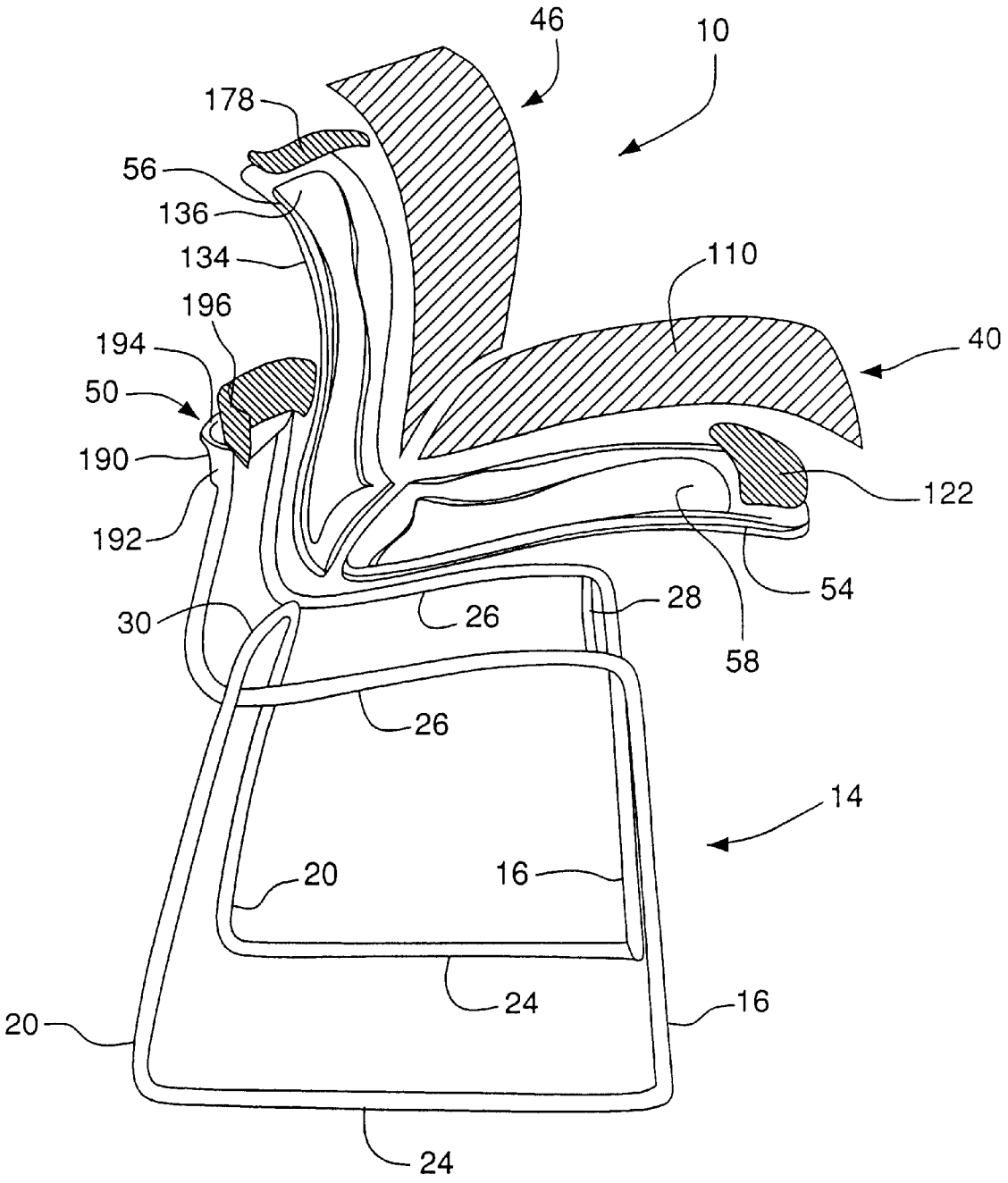
FIG. 1 is an exploded perspective view a chair constructed in accordance with a presently preferred form of the invention.

As best seen in FIG. 1, a chair 10 constructed in accordance with a presently preferred form of the invention comprises a base 14. The base 14 is comprised of metal tubing or bars that are bent to define front legs 16 and rear legs 20.

At their bottom, the front and rear legs 16 and 20 on each side of the chair 10 may be connected by lower spacers 24. At their top, the front and rear legs 16 and 20 may be connected by a upper spacers 26. Front and rear transverse spacers 28 and 30 provide additional support for the chair 10.

The upper spacers 26 support the seat 40 of the chair while upwardly directed members 44 which may be a part of the base 14 support the back 46 of the chair 10 and a lumbar support 50.

As will be further explained, both the seat 40 and back 46 comprise open frames 54 and 56 which may be made of a suitable molded thermoplastic, or of metal or wood. The frames 54 and 56 both carry woven mesh supports made of a thermoplastic for supporting the body of a person.

Figure 2:
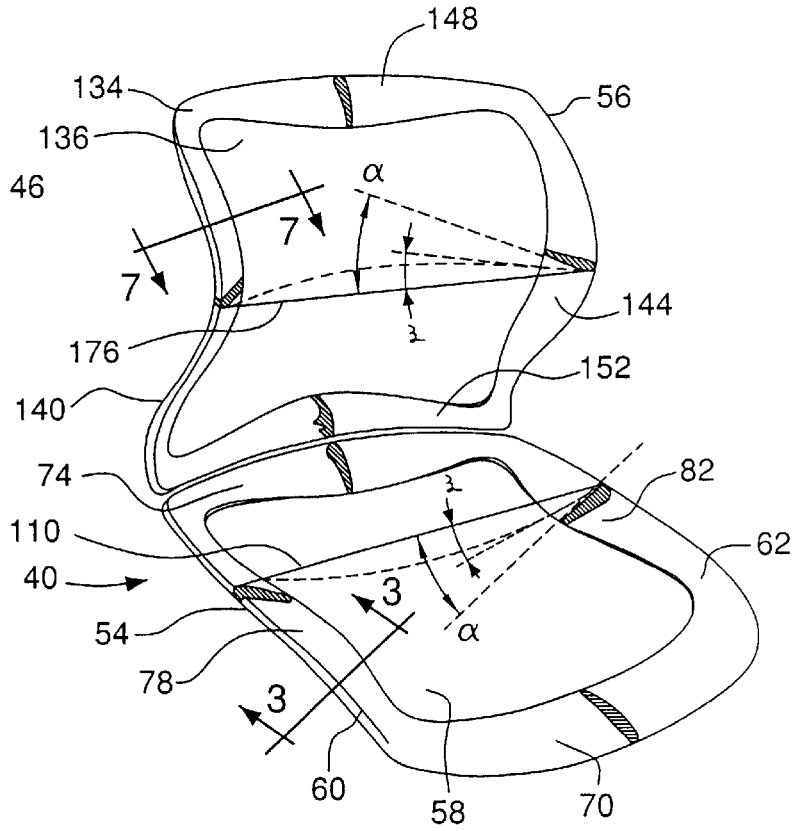
FIG. 2 is a perspective view of the frames comprising the seat and back of the chair shown in FIG. 1.

As best seen in FIGS. 1 and 2, the frame 54 of seat 40 comprises includes a central opening 58. While the frame 54 may be of any convenient shape, it is preferred that it be generally rectangular as illustrated with sides 60 and 62 and front and rear members 70 and 74.

The frame 54 can be can be one integral piece as by being molded, cast or forged, or it can be manufactured in a plurality of sections which are assembled as by welding, gluing or by in any other suitable manner.

The sides 60 and 62 of the frame 54 are curved so that the front 70 of the frame 54 turns generally downwardly to minimize the strain and discomfort to the lower thighs and the backs of the knees of the person sitting on the chair. Further, the sides 60 and 62 are of increased thickness at their mid-portions 78 and 82 to resist bending under the stress of a person sitting in the chair.

Figure 3:
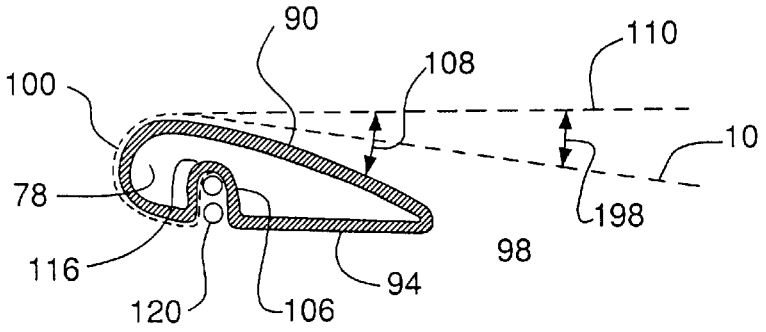
FIG. 3 is a cross-section view taken along line 3—3 of FIG. 2.

As best seen in FIGS. 2 and 3, the cross-section of the frame 54 is generally triangular. Thus, it includes an upper surface 90 and a lower surface 94 which are angularly disposed with respect to each other so that they converge to define a generally rounded vertex 98 on the inner periphery of the frame 54.

The diverging ends of the upper and lower surfaces 90 and 94 are joined by a rounded surface 100 which defines the outer periphery 104 of the frame 54.

The bottom surface 94 includes a groove 106 which is disposed around the entire frame 54.

As best seen in FIG. 2 and 3, upper surface 90 slopes downwardly and inwardly toward the opening 58 at a predetermined angle 108.

A mesh body support surface 110 supported by the frame 54 comprises longitudinal and transverse elastomeric fibers which are interwoven to define the surface. The mesh body support is supported on the frame 54 by being stretched over the juncture of the upper and outer surfaces 90 and 100 and being inserted in the groove 106 (FIG. 3).

Figure 4:
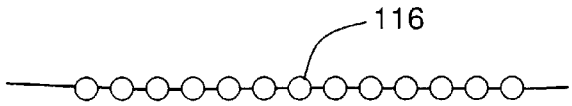
FIG. 4 is a view of one of form of the means for retaining a mesh supporting surface on the frames shown in FIG. 2
Figure 5A:
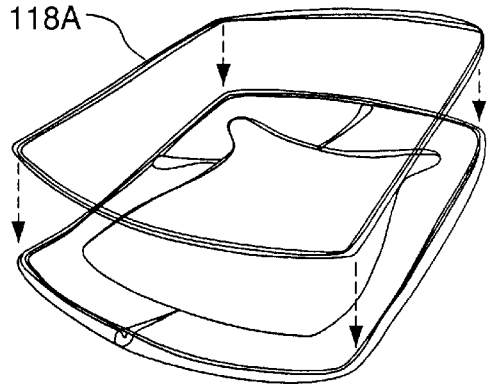
FIG. 5A is another form of the retaining mean shown in FIG. 5.
Figure 5:
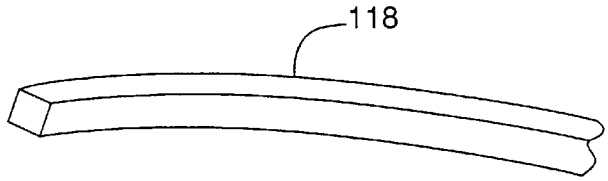
FIG. 5 is another form of the retaining means shown in FIG. 4.

The mesh body support 110 is retained in the groove 106 by locking beads 116 which may be on a string (FIG. 4), or an elongated strip 118 (FIG. 5) or a one piece annular strip 118A (FIG. 5A) both of which are comprised of resilient material are forced into the groove 106. Both the beads 116 and the elongated strip 118 are forced into the groove 106 with sufficient force to resist the tendency to be pulled out by the weight of a sitting person. A decorative molding 120 can be placed over the groove 116 to hide the beads 116 or resilient strip 118.

To increase the comfort of the seat and to further minimize fatigue, a pad or cushion 122 made of a soft resilient material can be provided on the front 70 of frame 54 between the upper surface 90 and the mesh supporting surface 110.

Figure 6:
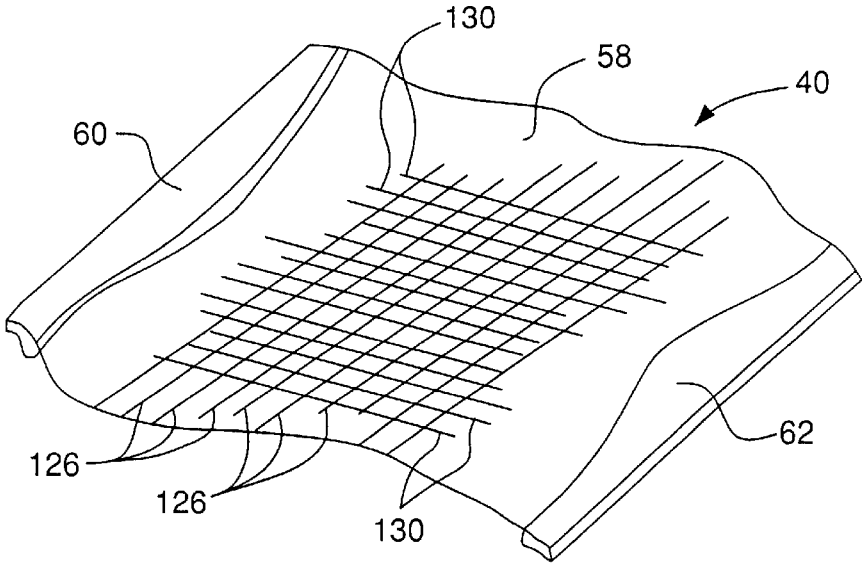
FIG. 6 is a view of a mesh supporting surface in accordance with the invention.

As best seen in FIG. 6, the mesh support surface 110, as explained earlier, is comprised of longitudinally and transversely extending elastomeric fibers 126 and 130.

The elastomeric fibers 130 are stretched to a predetermined tension before they are connected to the frame. Preferably, the transverse elastomeric fibers 130 which are between the front 70 and rear 74 of the frame 54 will carry a greater portion of the weight of a person sitting in the chair compared to the transverse elastomeric fibers 130 which are nearer the front and rear of the frame 54. Therefore, the transverse elastomeric fibers which are between the front and rear of the frame 54 are stretched to a greater tension than those fibers which are likely to support less weight. The effect of this is to provide a seat which is suitable for persons of different body weights and which is comfortable and which minimizes fatigue.

The seat frame 54 is connected to the base by suitable screws which are connected through tabs (not shown) on the base 14.

The back 46 of the chair is constructed in a manner similar to the seat 40 and thus need not be described in detail. The back 46 comprises a frame 134 defining a central opening 136. The frame 134 includes sides 140 and 144, a top 148 and a bottom 152.

Figure 7:
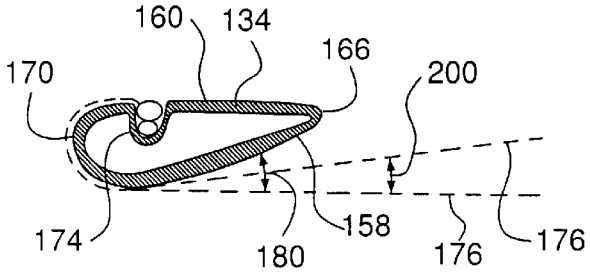
FIG. 7 is across-section view taken along line 7—7 of FIG. 2.

The cross-section of the back frame 134 which is illustrated in FIG. 7 is similar to the cross-section of the seat frame 54 as seen in FIG. 3. Thus, the back frame 134 includes upper and lower surfaces 158 and 160 which are angularly disposed with respect to each other so that they converge to a generally rounded vertex 166.

At their other ends, they are joined by a rounded outer surface 170. The lower surface 160 includes a groove 174 that supports another mesh supporting surface 176 in a manner which has been described.

As best seen in FIGS. 2 and 7, upper surface 158 slopes rearwardly and inwardly toward the opening 136 at a predetermined angle 180.

The back frame is connected to upwardly extending members 44 by bolts or other suitable fasteners (not shown).

To increase the comfort of the seat and to further minimize fatigue, a pad or cushion 178 made of a soft resilient material can be provided on the top 148 of frame 134 between the upper surface 158 and the mesh supporting surface 176.

The lumbar support 50 (FIG. 2) comprises a relatively wide strip 190 made from metal or plastic which is connected at its ends 192 to upwardly extending members 44.

The strip 190 is bowed away from the seat frame as at 194. Preferably, a layer of cushioning 196 is supported on the strip.

As explained earlier, the mesh supporting surfaces are stretched so that they are under tension before they are connected to their respective frames. The transverse fibers 130 in different locations on the seat 40 and back 46 can be stretched to different tensions to distribute the weight of the person sitting on the chair to further increase comfort and further reduce fatigue.

Significantly, it should be appreciated that when a person is sitting on the chair and the mesh support surfaces 110 and 176 deflect in the direction of the upper surfaces 90 and 180. However, the angles of deflection 198 (FIG. 3) and 200 (FIG. 7) are less than the angles 108 and 180 that the upper surface 90 and 158 of the seat frame 54 and back frame 134 make with the horizontal so that the mesh supporting surfaces 110 and 176 are supported by the outer periphery of the frames 54 and 134 of the seat and back, rather the inner peripheries.

This increased span is important in maximizing the comfort and reducing the fatigue of the person sitting on the chair since appropriate deflections for a range of body weights can be accomplished while still avoiding the likelihood that the mesh supporting surfaces will engage the upper surfaces 90 and 158 and without increasing the width of the chair.

Figure 8:
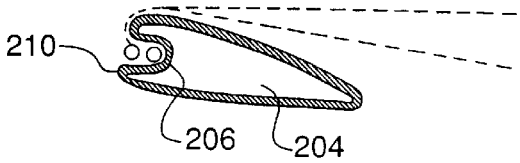
FIG. 8 is a view similar to FIGS. 3 and 7, but showing another form of the invention.

Additionally, in FIG. 8 a cross section of an alternative 204 to frames 54 and 134 is illustrated. In frame 204 the groove 206 is located in the outer surface 210. The mesh supporting surface is retained in the groove 206 in the manner described. Significantly the same advantages flowing from having the grooves on the bottom surface are present with the groove on the outer surface.

Figure 9:
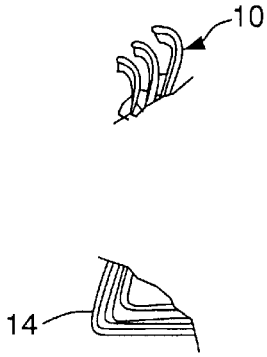
FIG. 9 is a side view of a stack of chairs of the type shown in FIG. 1.

FIG. 9 shows a chair 10 stacked on an identical chair. Stacking is possible because of the open construction of the base 14.

Figure 10:
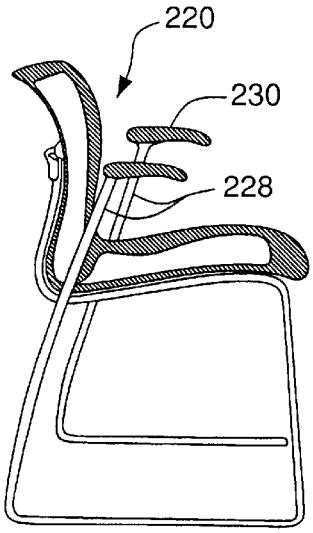
FIG. 10 is a side view of another form of the chair shown in FIG. 2.

FIG. 10 shows a chair 220 which is an alternate embodiment of the chair illustrated in FIG. 1. In chair 220, the rear legs of the frame extend upwardly as at 228 to support armrests 230.

Figure 11:
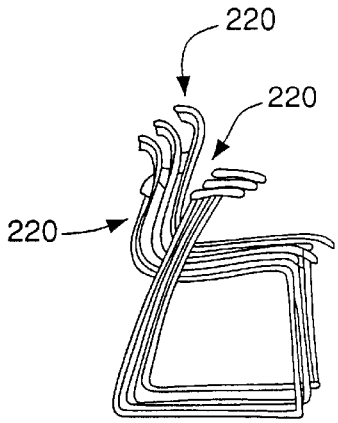
FIG. 11 is a side view of a stack of chairs of the type shown in FIG. 9.

As described with respect to chair 10, the open construction of the frame of the chair enables it to be stacked on another chair of identical design such as shown in FIG. 11.

While the invention has been described by reference to particular embodiments, it is apparent that other embodiments will be obvious skilled in the art. Thus, the scope of the invention should not be limited by the foregoing description, but rather only by the scope of the appended claims.

I claim:

1. An ergonomic chair comprising:

a frame, said frame comprising outer and inner peripheries defining a central opening, and an upper surface, a mesh supporting surface for supporting a portion of a body of a person, said mesh supporting surface being supported on said outer periphery of said frame, said mesh supporting surface being comprised of a yieldable resilient material said material is deflectable to at least a first pre-determined angle in the direction of said inner periphery of said frame when supporting a portion of the body of a person, and said inner periphery of said frame is disposed below the angle of deflection of said mesh so that said mesh does not engage said inner periphery when it supports a portion of the body of a person.

2. A chair as defined in claim 1 wherein said frame includes at least an upper surface that slopes inwardly toward said central opening and away from said mesh supporting surface.

3. A chair as defined in claim 2 wherein said mesh supporting surface is under tension when not supporting a portion of the body of a person.

4. A chair as defined in claim 2 wherein said frame includes a lower surface and an outer surface, and said outer surface and said upper surface defining said outer periphery.

5. A chair as defined in claim 2 wherein said frame includes a lower surface, and said lower surface includes means for connecting said mesh supporting surface to said frame.

6. A chair as defined in claim 4 wherein said mesh supporting surface is in engagement with said outer surface and said lower surface of said frame.

7. A chair as defined in claim 5 wherein said means on said lower surface comprises a groove, said mesh being in said groove, and means for retaining said mesh in said groove.

8. A chair as defined in claim 7 wherein said means for retaining said mesh in said groove comprises a plurality of beads.

9. A chair as defined in claim 8 wherein said beads are mounted on an elongated string.

10. A chair as defined in claim 7 wherein said means for retaining said mesh supporting surface in said groove comprises an elongated resilient member.

11. A chair as defined in claim 2 wherein said frame includes a lower surface, and said lower surface includes means for connecting said mesh supporting surface to said frame.

12. A chair as defined in claim 4 wherein said mesh supporting surface is in engagement with said outer surface and said lower surface of said frame.

13. A chair as defined in claim 11 wherein said means on said lower surface comprises a groove, said mesh being in said groove, and means for retaining said mesh in said groove.

14. A chair as defined in claim 13 wherein said means for retaining said mesh in said groove comprises a plurality of beads.

15. A chair as defined in claim 14 wherein said beads are mounted on an elongated string.

16. A chair as defined in claim 13 wherein said means for retaining said mesh supporting surface in said groove comprises an elongated resilient member.

17. A chair part for ergonomically supporting a portion of a body comprising a frame, said frame having a plurality of peripheral walls that define a central opening, a mesh supporting surface for supporting said portion of said body, said mesh supporting surface being supported by said peripheral walls, said mesh supporting surface being operable to deflect at a first angle when supporting a body portion, said peripheral walls having an upper surface, said upper surface being disposed at a second angle which is in the same direction as said first angle, and said first angle is less than said second angle.

18. A chair part as defined in claim 17 wherein said mesh comprises woven fibers, and said fibers are under tension when said chair part is not supporting a portion of a body.

19. A chair part as defined in claim 17 wherein said mesh comprises woven fibers, some of said fibers extend transversely across said frame, said frame having a mid-portion and ends, and said transversely extending fibers in the mid-portion of said frame are under more tension than the transverse fibers that are near the ends of said frame for distributing and support said body portion by reducing the deflection of said fibers.

20. A chair part as defined in claim 17 wherein said mesh comprises woven fibers, said fibers are comprised of a thermoplastic.

21. A chair part as defined in claim 17 including a cushion supported on the upper surface of at least one of said peripheral walls for cushioning said body portion, and said mesh supporting surface overlies said cushion.

22. A chair part as defined in claim 17 wherein said frame has an outer wall, said mesh supporting surface being in engagement with said outer wall, and means on said lower surface for connecting said mesh supporting surface to said frame.

23. A chair part as defined in claim 22 wherein said means on said lower surface comprises a groove, a portion of said mesh supporting surface being in said groove, and means for retaining said mesh supporting in said groove.

24. A chair part as defined in claim 23 wherein said means for retaining said mesh supporting surface in said groove comprises a plurality of beads.

25. A chair part as defined in claim 24 wherein said beads are mounted on an elongated string.

26. A chair part as defined in claim 24 wherein said beads are a part of said mesh.

27. A chair part as defined in claim 24 wherein said means for retaining said mesh supporting surface in said groove comprises an elongated resilient member.

28. A chair part as defined in claim 17 including a chair and legs, and back frame comprising a lumbar support, said lumbar support comprising a generally elongated flat transversely extending member, said lumbar support being connected at its ends to said legs, and said lumbar support is bowed away from said mesh supporting surface on said back frame when a person sits on said chair said mesh supporting surface is deflected toward and is spaced from said lumbar support.

29. A chair part as defined in claim 28 including a cushion supported on said lumbar support for cushioning the lumbar portion of the back of a person sitting on said chair.

30. A chair part as defined in claim 17 including a chair, and said chair is adapted to be telescopically received on another identical chair to form a stack of chairs.

31. A chair part as defined in claim 17 including a chair, and said chair includes a pair of armrests.

32. A chair part as defined in claim 31 including a chair having a seat and a pair of rear legs, a distal end of each of said legs extends above said seat, and said armrests are supported by said distal end.

33. A chair part as defined in claim 17 wherein said frame includes a mid-portion and ends that define a seat and a back, and said back is generally "S"-shaped, a chair and base, and the ends of said frame that define said seat and said back are supported by said base in close relation to each other to provide a continuous seating surface.

34. A chair part as defined in claim 17 wherein said frame for said seat has a front portion and said front portion turns downward.

35. A chair part as defined in claim 7 wherein said means for retaining said mesh supporting surface in said groove comprises a resilient annulus.

36. A chair part as defined in claim 13 wherein said means for retaining said mesh supporting surface in said groove comprises a resilient annulus.

* * * * *